US010210845B2

(12) United States Patent
Glen et al.

(10) Patent No.: US 10,210,845 B2
(45) Date of Patent: Feb. 19, 2019

(54) METHOD AND APPARATUS FOR COMPENSATING FOR VARIABLE REFRESH RATE DISPLAY RANGE LIMITATIONS

(71) Applicant: ATI Technologies ULC, Markham (CA)

(72) Inventors: David I. J. Glen, Toronto (CA); Syed A. Hussain, Scarborough (CA)

(73) Assignee: ATI Technologies ULC, Markham, Ontario (CA)

( * ) Notice: Subject to any disclaimer, the term of this patent is extended or adjusted under 35 U.S.C. 154(b) by 0 days.

(21) Appl. No.: 15/966,525

(22) Filed: Apr. 30, 2018

(65) Prior Publication Data

US 2018/0247616 A1 Aug. 30, 2018

Related U.S. Application Data

(63) Continuation of application No. 14/661,868, filed on Mar. 18, 2015, now Pat. No. 9,984,664.

(51) Int. Cl.
*G09G 5/395* (2006.01)
*G09G 5/00* (2006.01)

(52) U.S. Cl.
CPC ..... *G09G 5/395* (2013.01); *G09G 5/005* (2013.01); *G09G 2320/0247* (2013.01); *G09G 2340/02* (2013.01); *G09G 2340/0435* (2013.01); *G09G 2360/08* (2013.01)

(58) Field of Classification Search
CPC ..... G09G 2340/0435; G09G 5/18; G09G 2320/0247; G09G 2360/08; G09G 2360/18; G09G 5/005; G09G 5/393; G09G 5/395; G09G 5/363
See application file for complete search history.

(56) References Cited

U.S. PATENT DOCUMENTS 8,334,857 B1 * 12/2012 Ogrinc ..... G09G 5/377 345/204
8,542,221 B1 9/2013 Wyatt
2006/0077290 A1 4/2006 Chung et al.
(Continued)

OTHER PUBLICATIONS

United States Patent and Trademark Office; Non-Final Rejection; U.S. Appl. No. 14/589,560; dated Jun. 15, 2016.
(Continued)

*Primary Examiner* — Hong Zhou
(74) *Attorney, Agent, or Firm* — Faegre Baker Daniels LLP

(57) ABSTRACT

Briefly, methods and apparatus provide image content to, and display image content on, displays with a variable refresh rate that reduce frame delays and avoid display image flickering problems. In one example, the methods and apparatus are operative to vary a display's refresh rate by varying a current frame's vertical blanking period by re-providing the current frame for display prior to providing a new frame for display. In this fashion, the displaying of a new frame may be advanced by assuring that a new frame can be provided for display as soon as it has been rendered and available for display. In addition, by re-providing the current frame for display prior to providing a new frame for display, new frames may be provided for display at rates within a safe rate range such that display image flickering issues are avoided or reduced.

20 Claims, 9 Drawing Sheets

(56) References Cited

U.S. PATENT DOCUMENTS

| | | | | |
|---|---|---|---|---|
| 2008/0309652 | A1 | 12/2008 | Ostlund | |
| 2012/0242662 | A1 | 9/2012 | Ninan et al. | |
| 2012/0300123 | A1 | 11/2012 | Lares | |
| 2014/0184629 | A1 | 7/2014 | Wyatt et al. | |
| 2015/0348509 | A1 | 12/2015 | Verbeure | |
| 2015/0348511 | A1 | 12/2015 | Oriol et al. | |
| 2016/0125785 | A1* | 5/2016 | Wang | G09G 5/001 345/582 |
| 2016/0196801 | A1 | 7/2016 | Glen | |

OTHER PUBLICATIONS

United States Patent and Trademark Office; Final Rejection; U.S. Appl. No. 14/589,560; dated Nov. 29, 2016.
United States Patent and Trademark Office; Non-Final Rejection; U.S. Appl. No. 14/589,560; dated May 5, 2017.
United States Patent and Trademark Office; Non-Final Rejection; U.S. Appl. No. 14/661,868; dated Sep. 28, 2016.
United States Patent and Trademark Office; Final Rejection; U.S. Appl. No. 14/661,868; dated May 16, 2017.

* cited by examiner

METHOD AND APPARATUS FOR COMPENSATING FOR VARIABLE REFRESH RATE DISPLAY RANGE LIMITATIONS

CROSS-REFERENCE TO RELATED APPLICATIONS

This application is a continuation of U.S. patent application Ser. No. 14/661,868, filed on Mar. 18, 2015, which is related to U.S. patent application Ser. No. 15/884,855, filed on Jan. 31, 2018, which is a continuation of U.S. patent application Ser. No. 14/589,560 (now U.S. Pat. No. 9,911,397), filed on Jan. 5, 2015, the contents of all which are incorporated by reference herein for all that it discloses.

BACKGROUND OF THE DISCLOSURE

The disclosure relates generally to providing image content to, and displaying image content on, displays, and more particularly to methods and apparatus for reducing frame delay and other problems associated with providing and displaying image content on displays with a variable refresh rate. Displays that support variable refresh rates typically operate within a range of supported refresh rates at which the displayed image must be updated periodically. Discrepancies in the viewed image may result if the display is not refreshed at a refresh rate within its supported range of refresh rates. For example, a display with a variable refresh rate may have a supported refresh rate range between a minimum display refresh rate, and a maximum display refresh rate, whereby the minimum and maximum display refresh rates define the boundaries of the range of supported refresh rates. Frames for display may be rendered and made available (e.g. presented) to the display at a rate within its supported refresh rate range. The render rate is the rate at which frames, typically new frames, are generated. For example, a graphics processing unit (GPU) may generate new frames at a certain render rate. Once rendered, new frames may be presented to the display at a presentation rate.

For example, a display may be displaying a current frame when a new frame is rendered and made available at a rate within the supported refresh rate range of the display. In this instance, the display may be refreshed with the new frame at a time dictated by this refresh rate. If, however, a new frame is rendered and made available for display at a rate less than the minimum display refresh rate, the display is refreshed with a current frame at a time corresponding to the minimum display refresh rate, such that the display is refreshed with the same current frame more than once. This can prevent, for example, image tearing (i.e. the displaying of an image whereby part of the image is from one frame, and another part of the image is from another frame). Thereafter, the display may be refreshed with the new frame at a rate corresponding to the maximum display refresh rate.

For example, a display may support a refresh rate range of 30 Hz to 120 Hz. Accordingly, it may not be possible to refresh the display at a rate faster than at a rate of 120 Hz without causing image tearing. Thus, if the display is refreshed with a current frame, and a new frame does not become available at a rate within 30 Hz to 120 Hz, the display is refreshed at a time corresponding to a 30 Hz refresh rate with the same current frame. The display, however, cannot be refreshed with the new frame, without image tearing, at a rate faster than 120 Hz. Thus, although a new frame may be rendered at a time corresponding to a render rate faster than 120 Hz (for example, 5 msec), the display may not be refreshed with the newly rendered frame sooner than until about 8.33 milliseconds (corresponding to a refresh rate of 120 Hz, i.e. 1/120 Hz seconds) have passed since the last display refresh. Thus, because the displaying of the new frame may be delayed, input lag, e.g., the amount of time between when a change to a display image is provided and when the result appears on the display, may be increased. For example, in video gaming, a key desire is to minimize input lag, so that when a user provides for an action (e.g. hits a key to move a character), the result of that action is seen as quickly as possible on the display.

Other problems, such as display flickering, may occur if a display is updated at a rate close to its maximum or minimum supported refresh rates. For example, if a display is updated at a rate near the minimum supported display refresh rate, followed by updating the display at a rate near its maximum supported display refresh rate, the display may flicker, causing unwanted discrepancies in the viewed image. Thus, for displays experiencing these issues, images ideally would be rendered and made available to them at rates well within their supported display refresh rate range. Therefore there is a need to minimize frame delays that may increase input lag times, along with other undesirable effects such as display flickering, in the displaying of images on displays that support variable refresh rates.

BRIEF DESCRIPTION OF THE DRAWINGS

The embodiments will be more readily understood in view of the following description when accompanied by the below figures and wherein like reference numerals represent like elements, wherein.

DETAILED DESCRIPTION OF THE PREFERRED EMBODIMENTS

Figure 1:
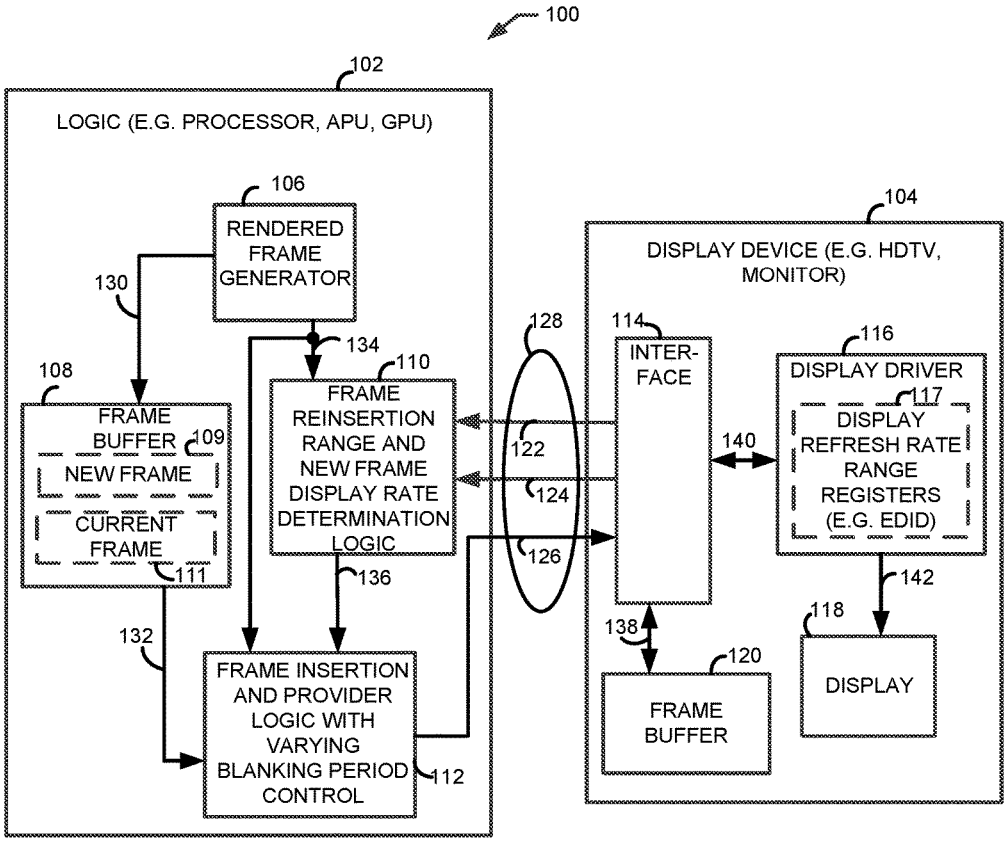
FIG. 1 is a functional block diagram illustrating an example device that includes frame reinsertion range and new frame display rate determination logic, and frame insertion and provider logic with varying blanking period control, which may be associated with a processor, such as, for example, a graphics processing unit (GPU), that provides display content to a display device.

Briefly, methods and apparatus to provide image content to, and display image content on, displays that support variable refresh rates that reduce frame delays and avoid display image flickering problems are disclosed. In one example, the methods and apparatus vary a display's refresh rate by, for example, varying a current frame's vertical blanking period (i.e. the time between the end of the final line of a frame and the beginning of the first line of the next frame) by re-providing the current frame for display prior to providing a new frame for display. In this fashion, the time period during which a display may be refreshed can be, in effect, advanced in time to ensure that the new frame can be provided for display as soon as it has been rendered and become available for display. The render rate of a provided video frame may be calculated, for example, with respect to the previously rendered frame or frames. For example, if a first frame is rendered at time a, and the next frame is rendered at time b, the render rate of the next frame may be calculated by: (1/(time b−time a)) frames per second (FPS). Similarly, the render rate may be calculated with respect to the times when subsequent frames are provided to a display, or to when subsequent frames are actually displayed.

In one example, by varying a display's refresh rate, new frames may be provided for display at a rate within a safe rate range such that display image flickering issues are avoided. For example, a new frame may be made available for display at a rate outside the safe rate range. To provide the new frame to the display at a rate within the safe rate range, the display's refresh rate is varied, for example, by re-providing a current frame to the display such that the vertical blanking period of the current frame is varied. In this fashion, the new frame may then be provided to the display at a rate within the safe rate range. Safe rate ranges may fall within a display's supported variable refresh rate range but exclude, for example, certain refresh rates within the display's supported variable refresh rate range. The excluded rates can be, for example, those that may lead to flickering of the display image. For example, a display may support a variable refresh rate range whereby the minimum refresh rate is 30 Hz and the maximum refresh rate 120 Hz. While the display supports this refresh range, the display may nonetheless exhibit less flicker when provided with frames at rates that are, for example, at least 5 Hz greater than the minimum or 5 Hz less than the maximum supported refresh rates (i.e. within the ranges of 35 Hz to 115 Hz). Accordingly, safe rate ranges may be determined for displaying frames.

Although the example of varying a display's refresh rate by varying a current frame's vertical blanking period is contemplated, it will be appreciated that display refresh rates may be varied by other methods as well. For example, a display's refresh rate may be varied by adjusting the pixel rate of the display, such as by adjusting the pixel clock to the display. Other methods of varying a display's refresh rate include adjusting the horizontal active pixel period, adjusting the horizontal blanking period, or any combination of these or other known methods.

In one embodiment, logic, for example, a processor such as a GPU, determines that a new frame is to be displayed at an expected new frame display rate, and varies the current frame's vertical blanking period by re-providing the current frame for display. The logic may re-provide the current frame for display, for example, at the maximum supported refresh rate of the display. For example, a display may have a display refresh rate range of 30 Hz to 120 Hz and a new frame may be rendered and made available for display at a time corresponding to a rate of 29 Hz. (This display refresh rate range is only exemplary and is not meant to be limiting. As is appreciated, a display refresh rate range may be a subset of continuous rates, any number of discrete rates, etc.) In this example, although the new frame was provided at a time corresponding to a rate of 29 Hz, that rate is too slow to be accommodated by the display with a minimum display refresh rate of 30 Hz. As a result, the display would have to be refreshed with a current frame, as the new frame was not available within a time period corresponding to the minimum supported display refresh rate of 30 Hz. In addition, this results in the new frame being further delayed from being displayed at least until the next possible refresh period after the display is refreshed with the current frame, because the display cannot be refreshed while the display is in an active refresh with the current frame if image tearing is to be prevented. For example, the new frame may be delayed for a time period corresponding to a rate of 120 Hz (i.e. 1/120 seconds) after refreshing with the current frame. To avoid these delays in displaying the new frame, the logic determines that the new frame will be made available for display at an expected new frame display rate that is too late (e.g. at 29 Hz which is below the 30 Hz minimum supported rate) and in response varies the current frame's vertical blanking period by re-providing the current frame for display. For example, rather than waiting a time corresponding to 30 Hz (i.e. 1/30 seconds) to see if the new frame becomes available, the logic re-inserts the current frame at a time corresponding to the maximum supported display rate of 120 Hz (i.e. 1/120 seconds), with the result that the new frame will become available at a rate within the display's variable refresh rate. For example, when the new frame becomes available, the new frame may be provided to the display immediately because the display is not in an active refresh with the current frame.

Thus, as one advantage, the amount of time it may take new content to be displayed is reduced. As a result, content from a new frame may be provided to the display as it becomes available. This may be advantageous, for example, in high-speed gaming applications, whereby user experience is enhanced by reducing the amount of time it takes new content to appear on one or more displays. Other advantages will be recognized by those of ordinary skill in the art.

In one embodiment, logic determines whether a new frame display rate for a new frame (the display rate determined for the new frame) falls within a frame reinsertion range that includes either the minimum supported display refresh rate or the maximum supported display refresh rate of the display. Thus, there may be more than one frame reinsertion range, such that one includes the minimum supported display refresh rate, and another includes the maximum supported display refresh rate, of the display. A frame reinsertion range includes a range of frame rates whereby the rates may include rates within, as well as outside of, a display's supported variable refresh rate range.

For example, for a sample display with a variable refresh range of 30 Hz to 120 Hz, a frame reinsertion range may be determined to be 28 Hz to 32 Hz which includes the display's minimum supported display refresh rate (i.e. 30 Hz). Thus, the frame reinsertion range may go below the minimum supported refresh rate of the display, or may even have no lower bound. In one example, the frame reinsertion range includes the minimum supported display refresh rate, and the logic re-provides the current frame for display if the new frame display rate falls within the frame reinsertion range. The current frame is re-provided at a rate equal to or greater than the minimum supported display refresh rate of the display. The frame reinsertion range may be, for example, a percentage range from the minimum or maximum supported display refresh rate. In another example, the frame reinsertion rate may be determined empirically, may be based on historical operations, or any combination of these or other known methods.

In one embodiment, the determining, by the logic, of the new frame for display at the expected new frame display rate includes determining an average presentation rate for previously presented frames. The logic determines that a future frame will be provided by a frame generator for display at the expected new frame display rate when the determined average presentation rate is within the frame reinsertion range. For example, the recent average presentation time for new frames may be tracked. When the average presentation time gets close to or exceeds the maximum time the display can go without a new refresh (e.g. a frame reinsertion range that includes range the minimum supported display refresh rate), the display is refreshed again with the current frame as soon as the current refresh with the current frame completes. This may add more time for the rendering of the next new frame to complete before having to refresh the display.

In one example, the logic determines the average presentation rate for the previously presented frames by determining the average render rate for previously presented frames. For example, the logic may determine that the expected new frame rate is below the minimum supported refresh rate of a display based on an average render rate of previously rendered frames. In this example, the logic may re-provide a current frame for display such that if the new frame is rendered at a render rate below the minimum supported display refresh rate, the new frame may be provided to the display as soon as the new frame has been rendered. For example, assume that for a display with a minimum supported display refresh rate range of 30 Hz (corresponding to a maximum refresh period of approximately 33.33 milliseconds) and a maximum supported display refresh rate of 120 Hz (corresponding to a minimum refresh period of approximately 8.33 milliseconds), the expected new frame rate is determined to be approximately 29.4 Hz (e.g. indicating that it will take approximately 34 milliseconds to render the new frame). Rather than waiting a maximum refresh period of 33.33 milliseconds to determine if a new frame will be ready for display, and, assuming that a new frame was not ready for display prior to the expiration of the maximum refresh period, having to wait at least an additional minimum refresh period of 8.33 milliseconds before refreshing the display with a new frame, the current frame is re-provided to the display at a time corresponding to the minimum refresh period of 8.33 milliseconds. Thereafter, the new frame may be provided to the display when it becomes available if it becomes available at a time corresponding to a refresh rate within the display's supported refresh rate range. For example, if the new frame becomes available at a time corresponding to the previously expected new frame rate of 29.4 Hz, the new frame may be provided to the display at a time corresponding to a refresh rate of 38.9 Hz (e.g. 1/(34 milliseconds−8.33 milliseconds)). In one embodiment, the logic displays the current frame, the re-provided frame, and the new frame, where the re-provided frames are re-provided at the maximum supported display refresh rate. For example, the logic may include a display with a variable refresh rate.

As an alternate to averaging presentation or rendering rates, the expected new frame display rate may be determined in other ways. For example, the determination of the expected new frame display rate may be based on received content associated with a frame. In one example, the expected new frame display rate is based on information received in meta-data that is associated with received image content. The meta-data may include a declared predicted frame rate that indicates, for example, that video or movie content is provided at a certain rate, such as 25 or 30 frames per second. Another alternative to determining the expected new frame display rate is based on a median presentation or rendering rate. For example, the expected new frame display rate may be determined by calculating a median presentation rate for previously presented frames. Thus, the logic may, for example, determine that a future frame will be provided by a frame generator for display at an expected new frame display rate when a determined median presentation rate is within a frame reinsertion range.

In one embodiment, the frame reinsertion range includes the minimum supported display refresh rate, and the logic re-provides the current frame at a rate within a safe rate range that is within the display's supported variable refresh rate range. For example, for an example display with a variable refresh rate range of 30 Hz to 120 Hz, the frame reinsertion range may be determined to be 28 Hz to 32 Hz. If a frame is provided to the display at a time corresponding to a rate between 30 Hz and 32 Hz, the display image may flicker on this example display. The logic may determine a safe rate range that includes refresh rates above 32 Hz to 120 Hz. Thus, the logic may re-provide the current frame at a time corresponding to a rate within the safe rate range of 32 Hz to 120 Hz, for example, when a new frame is made available at a rate between 30 Hz and 32 Hz. In one example, a display may flicker when refreshed after a maximum refresh period corresponding to the display's minimum refresh rate followed by a minimum refresh period corresponding to the display's maximum refresh rate. However, by re-providing a current frame at a rate within the safe rate range, flicker of the display may be avoided, as further discussed below with respect to FIG. 7.

In yet another embodiment, the frame reinsertion range includes the maximum supported display refresh rate, and the logic re-provides the current frame at a time corresponding to a rate within a safe rate range that is within the display's supported variable refresh rate range. For example, for an example display with a variable refresh rate range of 30 Hz to 120 Hz, the frame reinsertion range may be determined to be 118 Hz to 122 Hz. If a frame is provided at a time corresponding to a rate between 118 Hz and 120 Hz, the image may flicker on this example display. The logic may determine a safe rate range that includes refresh rates below 118 Hz down to 30 Hz. Thus, the logic may re-provide the current frame at a rate within the safe rate range of 30 Hz to 118 Hz, for example, when a new frame is made available at a rate between 118 Hz and 120 Hz. In one example, the logic may re-provide the current frame at a rate within a safe rate range when a new frame is predicted to become available at a rate within the frame reinsertion range.

In one embodiment, the logic determines a new frame presentation duration based on a time difference between when a previous frame is presented for display and when a current frame is presented for display. For example, a trigger event (e.g. an interrupt to a CPU) may indicate that a new frame has been rendered. When a frame is rendered, however, there may be a delay before the frame is ready to be presented to the display. For example there may be system delays associated with notification of a rendered frame, such as, for example, delays associated with a CPU having to be interrupted to access the rendered frame. Alternatively, there may be a delay associated with a CPU having to make system calls to gain access to the rendered frame. Once the frame is ready to be presented to the display, however, the logic may determine a presentation duration (e.g. delay from the time the previous frame was presented for display to the time the current frame is presented for display) for that new frame. For example, the logic may determine a current frame presentation duration to be 24 milliseconds for a display with a variable refresh range of 40 Hz to 144 Hz, where the frame reinsertion range is determined to be 40 Hz to 42 Hz. The logic may also determine that the expected new frame display rate is within a frame reinsertion range when the determined new frame presentation duration dictates that the new frame will be available for display at a rate that falls within the frame reinsertion range. If the frame presentation duration is such that the frame will be ready for display at a time corresponding to a rate that is within the frame reinsertion range (i.e. the frame will be ready for display at a rate of 40 to 42 Hz), the logic may then vary the vertical blanking period to the current frame by re-providing the current frame for display, as described above. In one example, the logic may determine the frame presentation duration based on a historical average of presentation durations of previous frames. In another example, the logic may determine the frame presentation duration based on the render rate of previously presented frames. In one embodiment, the logic includes a processor executing driver code that will monitor the presentation duration of frames, and may also determine and adjust the safe rate range of the display. The processor may also re-provide the current frame to the display, thereby varying the vertical blanking period of the current frame.

Turning now to the drawings, and as described in detail below, one example of the presently disclosed system is a device including logic 102 that provides display content and a display device 104 that supports a variable refresh rate. The logic is operative to generate rendered frames and to determine a frame reinsertion range and a new frame display rate, and is further able to vary the vertical blanking period of frames by re-providing current frames (e.g., the logic may insert additional current frames for display). If a new frame is made available for display, for example, at a rate that falls within the frame reinsertion range, the logic may refresh the display device with the current frame so as to vary the vertical blanking period of the current frame. The display device supports a variable refresh rate and is operative to receive provided content that may be displayed, in part or in whole, on a display.

FIG. 1 is a functional block diagram illustrating an example device 100 that includes logic 102 and display device 104 as described above and in further detail below. The device 100 may be, for example, any suitable device that may provide or display images such as, but not limited to, a mobile or smart phone, a phablet, a tablet, a laptop computer, a desktop computer, a camera, a portable media player, a video gaming system, an internet based gaming system, or any other suitable device including any suitable battery-equipped device, for example. More specifically, as illustrated in FIG. 1, the device 100 includes logic 102 which includes frame reinsertion range and new frame display rate determination logic 110, frame insertion and provider logic with varying blanking period control 112, rendered frame generator 106, and frame buffer 108. In some embodiments, logic 102 may include one or more accelerated processing units (APU), CPU cores, GPU cores and associated memory, if desired, that includes executable instructions or video decompressors (e.g. H.264, H.265, MPEG video decompressors) on one or more dies. Additionally or alternatively, logic 102 may include discrete logic, one or more digital signal processors (DSPs), one or more field programmable gate arrays (FPGAs), or one or more application-specific integrated circuits (ASICs). In some embodiments, some or all of the functions of logic 102 and display device 104 may be performed by any suitable processors that may, for example, execute a software driver or firmware or any other suitable executable module.

Rendered frame generator 106 may generate rendered frames at a render rate that may be configurable or variable. For example, rendered frame generator 106 may include an accessible register that configures the render rate, among other functions. For example, a CPU that may be part of logic 102 may configure the render rate of rendered frame generator 106 via the accessible register. Rendered frame generator 106 may provide rendered frames via communication link 130, such as a bus, to frame buffer 108, whereby frame buffer 108 may store rendered frame data, such as new frames 109 and current frames 111. Alternately, rendered frame generator 106 may provide new frames directly to both frame buffer 108 and frame insertion and provider logic with varying blanking period control 112, thus alieving frame insertion and provider logic with varying blanking period control 112 from having to access frame buffer 108 for the new frame. Frame buffer 108 may be any suitable storage mechanism, including but not limited to memory, a hard drive, RAM, such as DDRAM or other suitable RAM, ROM in any suitable form, a cloud storage mechanism, or any suitable storage mechanism accessible via the web. Rendered frame generator 106 may also provide a new frame signal 134 to frame reinsertion range and new frame display rate determination logic 110 to determine whether the new frame was provided for display at a rate within a determined frame reinsertion range. For example, new frame signal 134 may be a signal indicating that a new frame has been rendered and is available for display, allowing frame reinsertion range and new frame display rate determination logic 110 to calculate the new frame render rate. Alternatively, new frame signal 134 may provide the new frame render rate, relieving frame reinsertion range and new frame display rate determination logic 110 from calculating the same. New frame signal 134 may also be provided to frame insertion and provider logic with varying blanking period control 112 to provide new frames over communication link 126, as discussed below.

Frame reinsertion range and new frame display rate determination logic 110 may receive a display's supported refresh rate range over communication link 122. Communication link 122 may be any suitable communication link that allows for the communication of display refresh rate range data which may be part of a display's extended display identification data (EDID). The frame reinsertion range and new frame display rate determination logic 110 may optionally receive, over communication link 124, display scan information such as whether the display is currently refreshing, and the current scan location that the display is refreshing at. Communication link 124 may be any suitable communication link that allows for the communication of display scan information.

Frame reinsertion range and new frame display rate determination logic 110 determines a frame reinsertion range, and also determines the rate at which a new frame may be made available for display (e.g. an expected new frame display rate). For example, the rate at which a new frame may be made available for display may be a predicted rate based on when the previous frame was made available for display. Alternately, frame reinsertion range and new frame display rate determination logic 110 may determine a rate at which a future frame may be made available for display, such as by determining an average presentation rate for previously presented frames and using the average presentation rate to predict the future frame display rate, as described above. Frame reinsertion range and new frame display rate determination logic 110 provides frame reinsertion signal 136 to frame insertion and provider logic with varying blanking period control 112, which indicates whether a new frame has been determined to be displayed at a rate within the frame reinsertion range. If frame reinsertion signal 136 indicates that a new frame is to be displayed at a rate within the determined frame reinsertion range, frame insertion and provider logic with varying blanking period control 112 may vary the vertical blanking period of a current frame for display by re-providing to the display device 104 the current frame over communication link 126. For example, frame insertion and provider logic with varying blanking period control 112 may access the current frame 111 in frame buffer 108 over communication link 132, and re-provide the current frame to display device 104. Communication link 126 allows frame insertion and provider logic with varying blanking period control 112 to provide display device 104 with frames for display, for example, such as new and current frames, over communication link 126. As noted above, frame insertion and provider logic with varying blanking period control 112 may receive new frames either directly from 106, or by accessing new frame 109 in frame buffer 108.

In another example, frame reinsertion range and new frame display rate determination logic 110 and frame insertion and provider logic with varying blanking period control 112 may both receive an indication that a new frame has been rendered, as indicated by new frame signal 134. Frame reinsertion range and new frame display rate determination logic 110 may then determine whether the new frame render rate is within a determined frame reinsertion range, and may indicate this determination over frame reinsertion signal 136 to frame insertion and provider logic with varying blanking period control 112. If the indication over frame reinsertion signal 136 is that the new frame rate is not within the determined frame reinsertion range, frame insertion and provider logic with varying blanking period control 112 may then provide the new frame to display device 104 over communication link 126 during a time period corresponding to a rate within the display device's 104 supported display refresh rate.

Communication links 122, 124, and 126 may each be any suitable communication link, including but not limited to a Display Port link, an HDMI link, $I^2C$ link, or any other suitable link, or may each be part of communication link 128. Communication link 128 may include other data communication signals or links, and may also be any suitable communication link, including Display Port, HDMI, or $I^2C$.

Display device 104 may be a display with a variable refresh rate and may include interface 114, display driver 116, display 118, and frame buffer 120. Interface 114 may provide information on communication links 122 and 124, and may receive frame content data on communication link 126, as described above. Interface 114 also provides frame content data over communication link 140. For example, interface 114 may receive frame data (e.g. frames) over communication link 126, and provide the data to display 118. In one embodiment, frame insertion and provider logic with varying blanking period control 112 provides frames directly to driver 116 via interface 114, for example, without a need for a frame buffer such as frame buffer 120. Display driver 116 may then receive frames from interface 114 over communication link 140, and, in turn, display driver 116 may provide the frames to display 118 over communication link 142. This embodiment may minimize delays and resources associated with implementing a frame buffer 120 in display 104.

In one example, frame insertion and provider logic with varying blanking period control 112 is in control of when frames are provided by display driver 116 to display 118 (e.g. display driver 116 provides frames to display 118 as they are received from frame insertion and provider logic with varying blanking period control 112). In another example, display driver 116 may have some or full control of when frames are provided to display 118. In yet another embodiment, interface 114 provides frames to frame buffer 120 over communication link 138. Display driver 116 would then access frame content data in frame buffer 120 via interface 114, and provide the frame content data for display to display 118. For example, the display driver 116 may, every display refresh cycle, obtain frame content data from frame buffer 120 and provide it to display 118. For example, if display device 104 supports a display refresh rate range of 30 Hz to 120 Hz, the display driver 116 may update the display 118 between approximately every 8.33 milliseconds to 33.3 milliseconds (i.e. 1/120 seconds to 1/30 seconds).

The display driver 116 may also contain display refresh rate range registers 117, which may be EDID registers, indicating the supported display refresh rate range of the display. For example, the display refresh rate range registers 117 may allow logic 102 to determine the minimum and maximum supported refresh rates of display device 104, which would allow logic 102 to provide frame content for display at those rates. The display refresh rate range registers 117 may also allow logic 102 to configure display driver 116 to refresh display 118 during a time period corresponding to a rate within the range of supported refresh rates.

Figure 2:
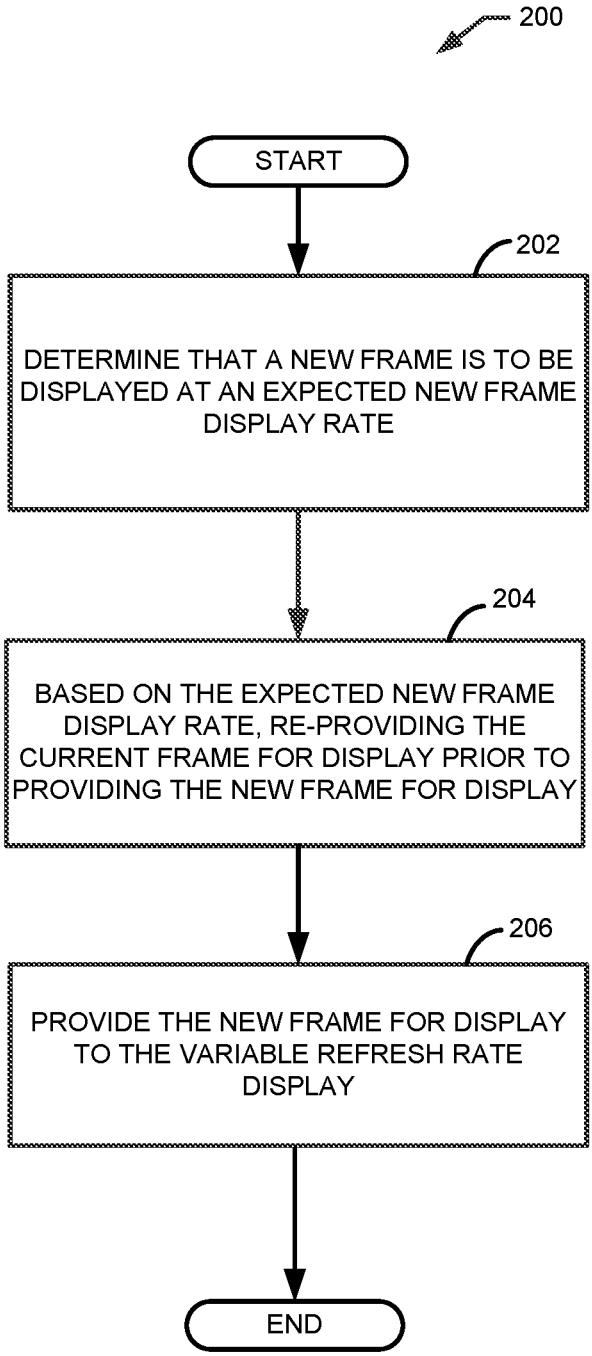
FIG. 2 is a flowchart of an example method for providing display content by varying a display's refresh rate by re-providing the current frame for display prior to providing a new frame for display.

FIG. 2 is a flowchart of an example method for providing frame content to a display. The method illustrated in FIG. 2, and each of the example methods described herein, may be carried out by logic 102. As such, the method may be carried out by hardware or a combination of hardware and hardware executing software. Suitable hardware may include one or more GPUs, CPUs, APUs, application specific integrated circuits (ASICs), state machines, field programmable gate arrays (FPGAs), digital signal processors (DSPs), and/or other suitable hardware. Although the method(s) is/are described with reference to the illustrated flowcharts (e.g., in FIG. 2), it will be appreciated that many other ways of performing the acts associated with the method(s) may be used. For example, the order of some operations may be changed, and some of the operations described may be optional. Additionally, while the method(s) may be described with reference to the example apparatus 100, it will be appreciated that the method(s) may be implemented by other apparatus as well, and that the apparatus 100 may implement other methods.

The example method begins at block 202 where a new frame is determined to be displayed at an expected new frame display rate, such as may be performed by frame reinsertion range and new frame display rate determination logic 110 of FIG. 1. For example, frame reinsertion range and new frame display rate determination logic 110 may determine that a new frame is to be displayed during a time period corresponding to an expected new frame display rate (e.g. a predicted new frame display rate) of 31 Hz, for a display device that supports a variable refresh range of 30 Hz to 120 Hz. The method continues to block 204, where, based on the expected new frame display rate, the current frame is re-provided for display prior to providing the new frame for display, such as may be performed by frame insertion and provider logic with varying blanking period control 112. For example, by re-providing one or more current frames to the display during a time period corresponding to a maximum supported display refresh rate, the vertical blanking period of the current frame may be extended beyond the maximum refresh period of the display, such that the new frame may be provided as soon as it becomes available for display. The method then continues to block 206, where the new frame is provided to the display. For example, the new frame, first determined to be displayed during a time period corresponding to the expected new frame display rate of 31 Hz, may now be displayed during a time period corresponding to a rate of around 64.1 Hz, after the current frame is re-provided to the display at a maximum supported display refresh rate of 120 Hz.

Figure 3:
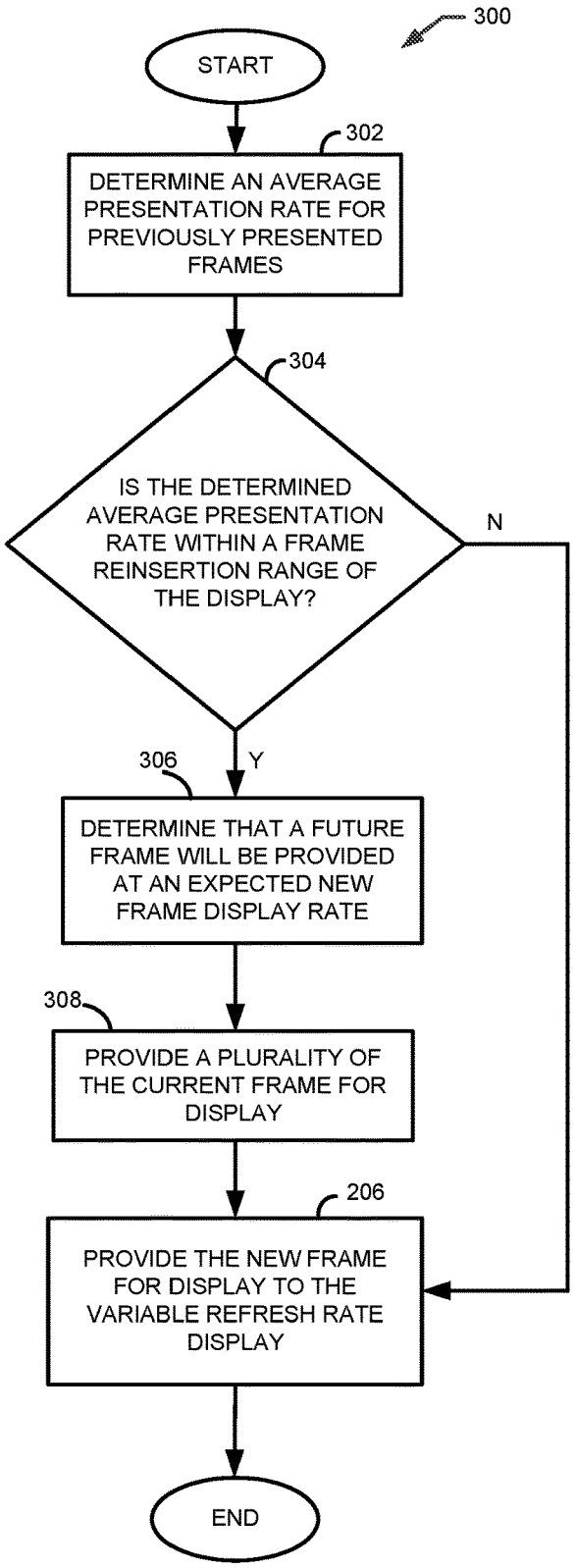
FIG. 3 is a flowchart of an example method for providing display content by determining an average presentation rate for previously presented frames and providing a plurality of current frames for display before providing a new frame for display.

FIG. 3 is a flowchart of another example method for providing display content to a display as may be performed, for example, by logic 102. The method begins at block 302, where an average presentation rate is determined for previously presented frames. The presentation rate may be computed, for example, by logic 102. For example, as described above, the computed presentation rate may be based on an average presentation rate of previous frames. In other examples, the computed presentation rate may also be based on other methods, such as a median presentation or render rate, or declared predicted frame rate, as described above. The method continues to decision block 304, to determine whether the determined average presentation rate falls within a frame reinsertion range of the display. For example, a display with a refresh range of 30 Hz to 120 Hz may be determined to have a frame reinsertion range of 28 Hz to 35 Hz. For example, as discussed above, the frame reinsertion range may be determined empirically. Thus, an average presentation rate of 34 Hz would fall within the frame reinsertion range. The average presentation rate may be based on, for example, the presentation rates for the last 10 frames. If the presentation rate is determined to not fall within the frame reinsertion range of the display, the method continues to block 206. Otherwise, the method continues to block 306, where it is determined that a future frame will be provided at an expected new frame display rate, which may be based on the calculated average presentation rate. For example, the next new frame may be determined to be provided at an expected new frame display rate that may be less than the minimum supported refresh rate of the display. By comparing how the new frame display rate prediction compares to the maximum refresh rate of the display, the method may determine the number of current frame reinsertions to perform. From block 306, the method continues to block 308, where one or more current frames are re-provided for display, such as to display device 104. By re-providing the current frame, the vertical blanking period of the current frame is extended, thereby allowing a new frame that would have been made available during the refreshing of the display with the current frame to be provided to the display at an earlier time. The method then proceeds to block 206, where the new frame is provided to the display as discussed above in describing FIG. 2.

Figure 4:
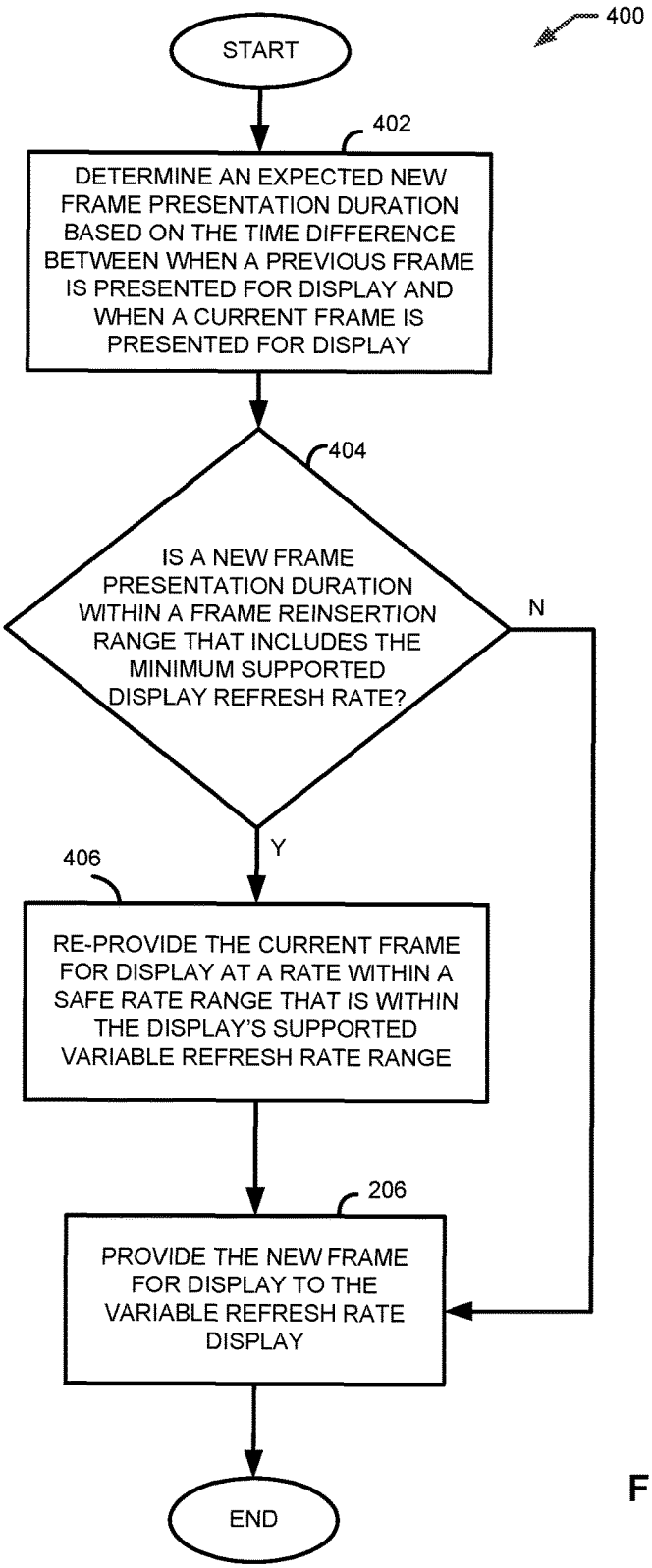
FIG. 4 is a flowchart of an example method for providing display content by determining a new frame presentation duration and determining whether the new frame presentation duration is within a frame reinsertion range that includes the minimum supported display refresh rate.

FIG. 4 is a flowchart of another example method for providing display content to a display as may be performed, for example, by logic 102. The method begins at block 402, where an expected new frame presentation duration is determined, based on the time difference between when a previous frame was presented for display, and when the current frame is ready to be presented for display. For example, when a frame is rendered, there may be a delay before the frame is ready to be presented to the display, such as those caused by system delays associated with notification of a rendered frame. The method then proceeds to decision block 404, where a determination is made as to whether the frame presentation duration for the new frame falls within a frame reinsertion range that includes the minimum supported display refresh rate. For example, for a display with a minimum supported display refresh rate of 30 Hz and a frame reinsertion range of 28 Hz to 35 Hz, a new frame presentation duration that makes the new frame available to be provided to the display at a rate of 32 Hz from the last provided frame would be determined to fall within the frame reinsertion range. If at decision block 404 a determination is made that the new frame presentation duration is not within a frame reinsertion range that includes the minimum supported display refresh rate, the method proceeds to block 206. Otherwise, the method proceeds to block 406, where the current frame is re-provided for display at a rate within a safe rate range that is within the display's supported variable refresh rate range. For example, and continuing the example from just above, the variable refresh display may be determined to have a safe rate range from 40 Hz to 110 Hz, where frames provided at these rates do not cause flicker on the displayed image. Thus, at block 406, current frames are re-provided to the display at a rate within this safe rate range. The method then proceeds to block 206, where the new frame is provided to the display as discussed above in describing FIG. 2. For example, the new frame may be provided at a display rate that falls within the safe rate range, thereby avoiding providing the new frame at a rate that may cause the displayed image to flicker, such as the flickering issues discussed below with respect to FIG. 7.

Figure 5:
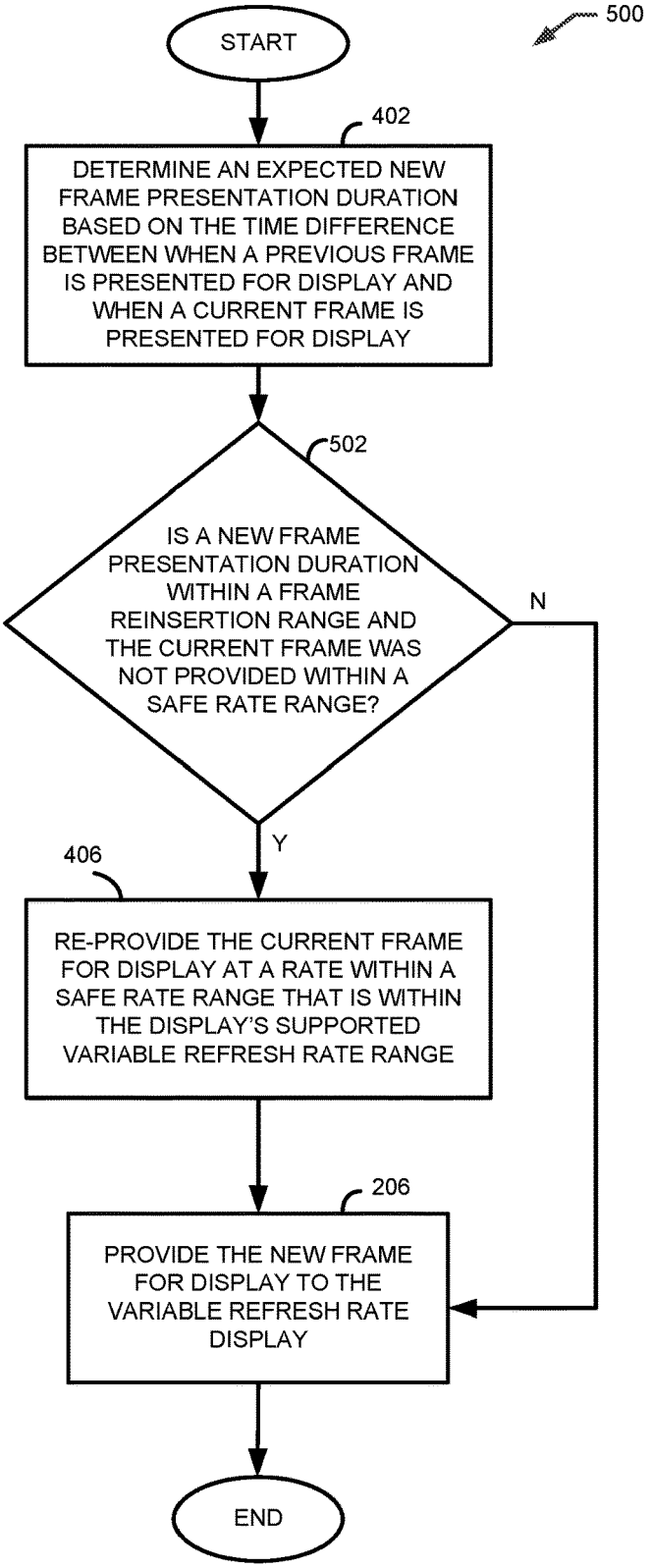
FIG. 5 is a flowchart of an example method for providing display content by determining a new frame presentation duration and determining whether the new frame presentation duration is within a frame reinsertion range that includes the maximum supported display refresh rate, and includes aspects of the methods illustrated in FIG. 4.

FIG. 5 is a flowchart of another example method for providing display content to a display as may be performed, for example, by logic 102. The method begins at block 402, where an expected new frame presentation duration is determined, as described above with respect to FIG. 4. The method then proceeds to decision block 502, where a determination is made as to whether the frame presentation duration for the new frame falls within a frame reinsertion range. The frame reinsertion range may include, for example, a display's maximum supported refresh rate or minimum supported refresh rate. For example, for a display with a maximum supported display refresh rate of 120 Hz, the frame reinsertion range may be determined to be 115 Hz to 120 Hz. Thus, a frame presentation duration of 118 Hz would be determined to fall within the frame reinsertion range. In addition, a determination is made as to whether the current frame was provided within a safe rate range. If at decision block 502 a determination is made that either the new frame presentation duration is not within a frame reinsertion range, or that the current frame was provided at a time corresponding to a rate within a safe rate range, the method proceeds to block 206. Otherwise, the method proceeds to block 406, where the current frame is re-provided for display at a rate corresponding to a rate within a safe rate range that is within the display's supported variable refresh rate range, as described above with respect to FIG. 4. For example, and as discussed further with respect to FIG. 7, if the current frame was provided at a time corresponding to a rate within a safe rate range, then display flicker issues may have been avoided, such that a current frame does not have to be re-provided at a time corresponding to a rate within the safe rate range to avoid the display flicker issues. The method then proceeds to block 206, where the new frame is provided to the display as discussed above in describing FIG. 2 and FIG. 4.

Figure 6:
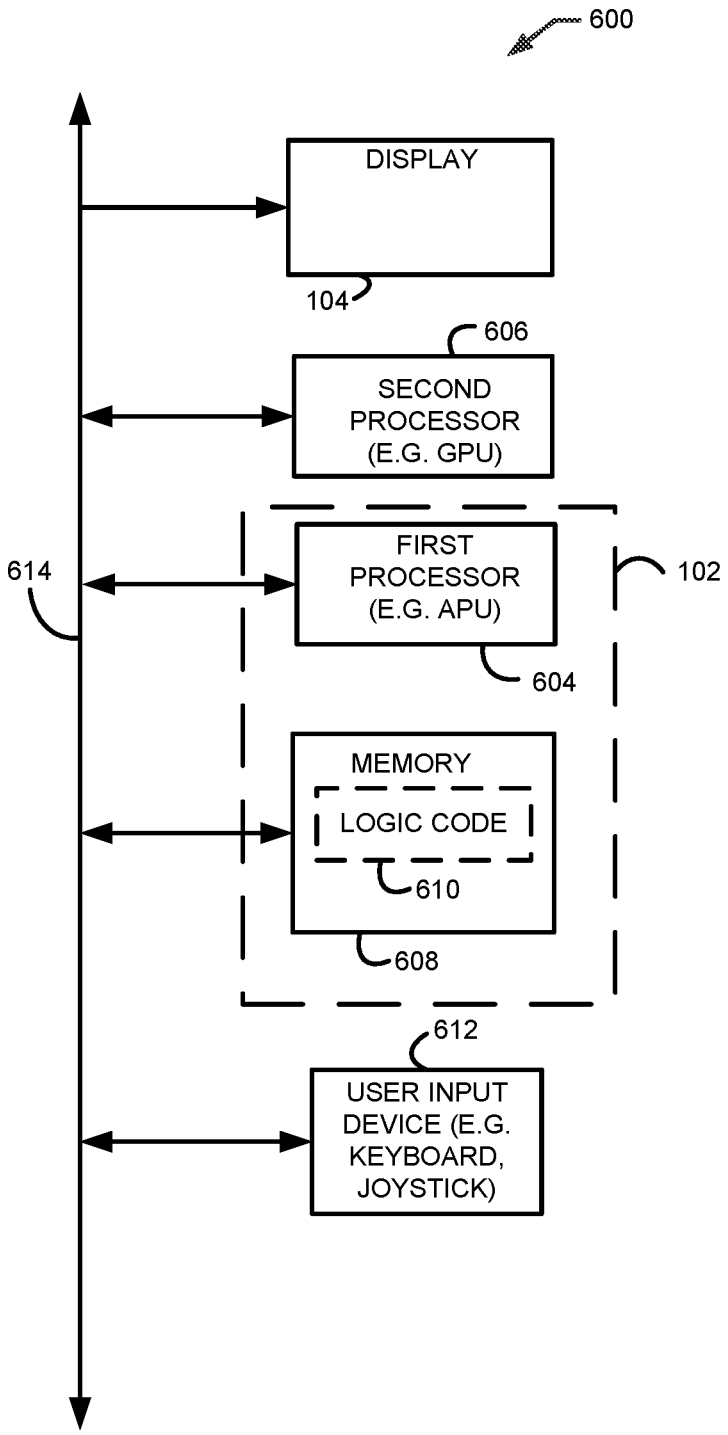
FIG. 6 is a functional block diagram illustrating an example apparatus including a central processing unit (CPU), a GPU, and logic code residing in memory.

In some examples, executable suitable instructions may be stored on a computer readable storage medium, where the executable instructions are executable by one or more processors to cause the one or more processors to perform the actions described herein. FIG. 6 is a functional block diagram of another example embodiment 600 that is shown to include a first processor 604 (e.g. CPU), second processor 606 (e.g. GPU), and memory 608. In some embodiments, memory 608 or any other suitable memory may store executable instructions including logic code 610 that when executed by first processor 604 performs some or all of the functions of logic 102 of FIG. 1. Similarly, memory 608 or any other suitable memory may store executable instructions that when executed by second processor 606 perform some or all of the functions of logic 102. For example, first processor 604 may execute instructions that perform the functions of frame reinsertion range and new frame display rate determination logic 110 and provider logic with varying blanking period control 112, while second processor 606 may execute instructions that perform the functions of the rendered frame generator 106 of FIG. 1.

First processor 604 and second processor 606 may access memory 608 over bus 614. Bus 614 can be, for example, any number of interconnects allowing communication among the various devices. Display 602 may include some or all of the functionality of the display device 104 of FIG. 1, and may receive frame content to be displayed over expansion bus 614. The received frame content may include, for example, re-provided content from a current frame before receiving content from a new frame. The example embodiment 600 may also include one or more of input device 612, for example, to allow a user to provide input, such as in gaming systems. Some or all of this functionality may also be implemented in any other suitable manner such as but not limited to a software implementation, including, for example, a driver implementation, a firmware implementation, a hardware implementation, or any suitable combination of the example implementations described above.

Figure 7:
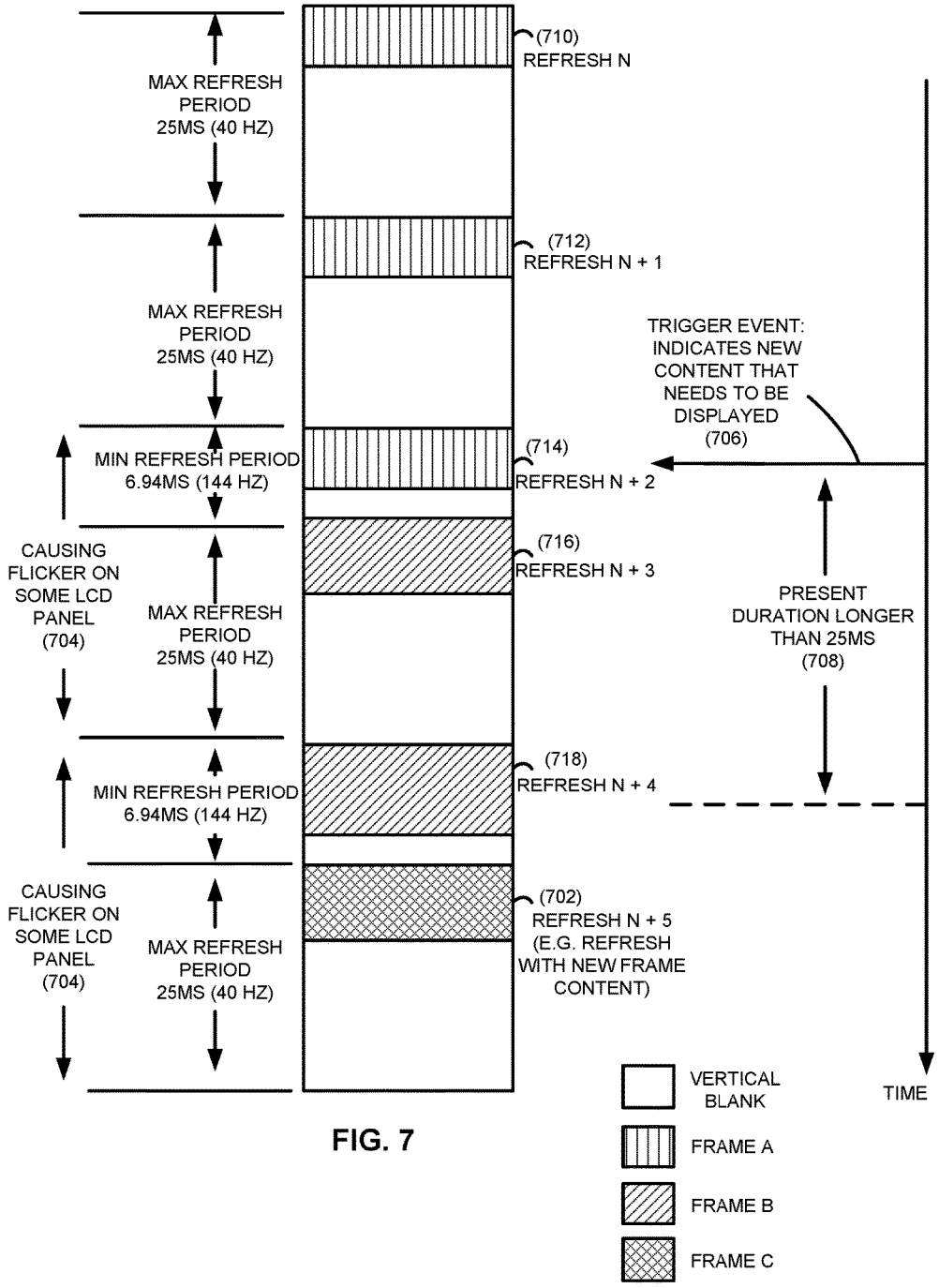
FIG. 7 is a frame timing diagram illustrating an example situation in which rendered frames may cause unwanted discrepancies in the displayed image, such as flickering of the displayed image, when refreshing a display with a variable refresh rate.

FIG. 7 is a frame timing diagram illustrating an example situation in which rendered frames may cause unwanted discrepancies in the displayed image, such as flickering of the displayed image, when refreshing a display with a variable refresh rate. The timing diagram illustrates the timing at which a display is refreshed. For example, as is illustrated, a display is refreshed with Refresh N+1 (712), corresponding to content from Frame A, after the maximum refresh period (e.g. minimum supported display refresh rate) of 25 milliseconds (i.e. 40 Hz) after being refreshed with Refresh N (710), which also corresponds to content from Frame A. Thus, Refresh N (710) provides content from a Frame A to be displayed, whereby Refresh N+1 (712) re-provides content from Frame A to be displayed (e.g. content from the same frame that was used in Refresh N (710)). Similarly, the display is refreshed with Refresh N+3 (716), corresponding to Frame B content, after the minimum refresh period (e.g. maximum supported display refresh rate) of approximately 6.94 milliseconds (i.e. 144 Hz) after the display is refreshed with Refresh N+2 (714). For a particular display, refreshing the display with a frame after a minimum refresh period, followed by refreshing the display at the maximum refresh period, may cause flickering in the displayed image, as is indicated in the diagram (704). Similarly, some displays may flicker when refreshing the display at a maximum refresh period followed by refreshing the display at the minimum refresh period. As indicated in the diagram, a trigger event (706), such as a CPU interrupt, may indicate that a new frame has been rendered. For example, a trigger event 706 may indicate that Frame C has been rendered. Due to the indicated presentation duration (708) that is longer than 25 milliseconds, however, Frame C may be provided to the display at earliest while the display is refreshing with Refresh N+4 (718), which corresponds to content from Frame B. Thus, the display is not refreshed with Refresh N+5 (702), which corresponds to content from Frame C, until a minimum refresh period from when the display is refreshed with Refresh N+4 (718), causing a delay to Refresh N+5 (702), and further causing the display flickering issues described above.

Figure 8:
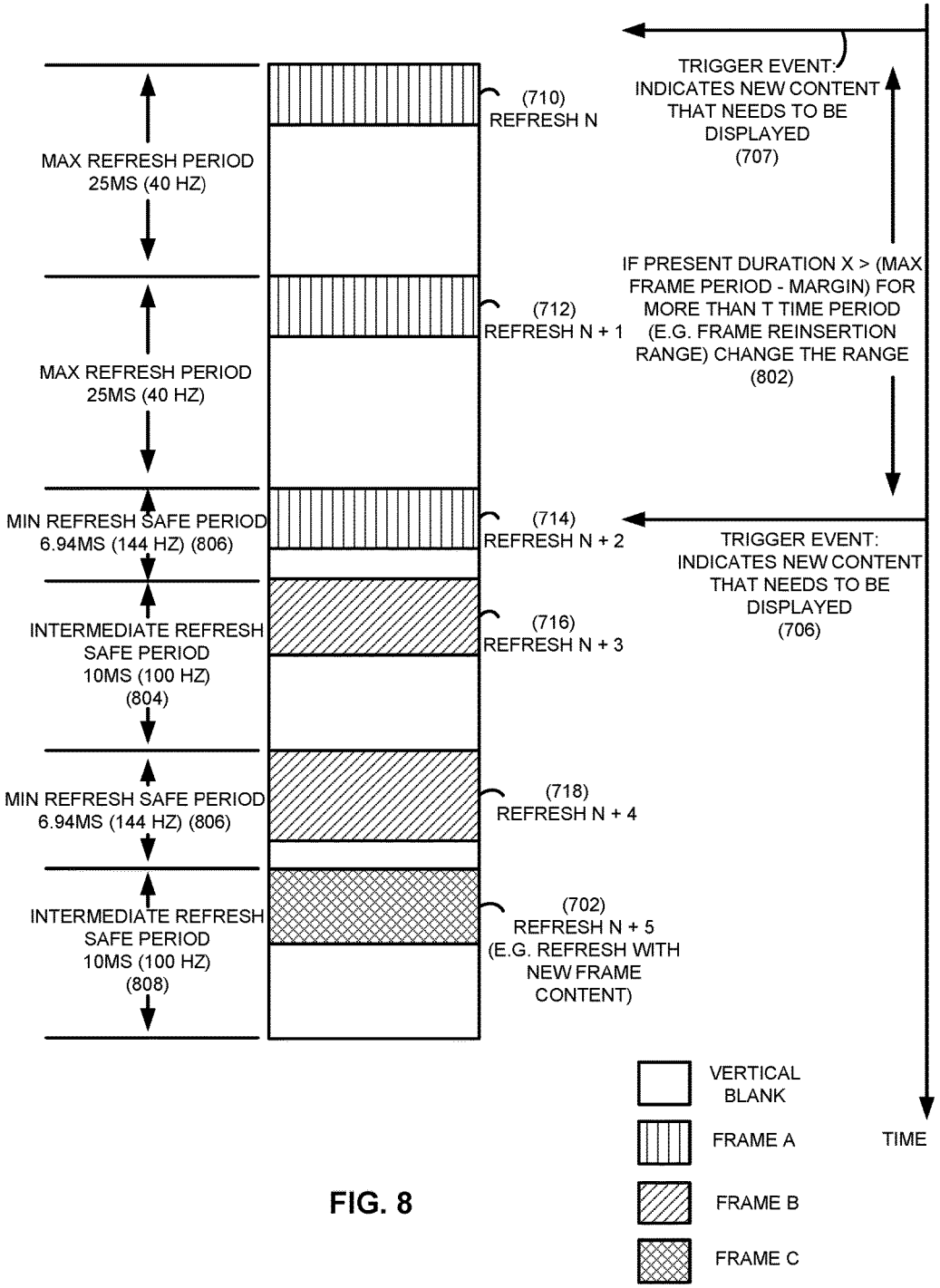
FIG. 8 is an example frame timing diagram illustrating the results of changing the blanking period of frames provided for display that may solve, for example, the problems associated with the timing diagram of FIG. 7.

FIG. 8 is an example frame timing diagram illustrating the results of changing the blanking period of frames provided for display that may solve, for example, one or more of the problems associated with the timing diagram of FIG. 7. For example, after a trigger event such as trigger event 706, if the determined presentation duration indicates that a new frame has been rendered and will need to be displayed during a time period corresponding to a range that falls within a frame reinsertion range, the range of the new frame may be varied. In the illustration, trigger 707 corresponds to the rendering of Frame B, and trigger 706 corresponds to the rendering of Frame C. The display is refreshed with Refresh N+4 (718), for example, by logic 102, after an intermediate refresh safe period of 10 milliseconds (804) (corresponding to a rate of 100 Hz), rather than at the maximum refresh period of 25 milliseconds (corresponding to a rate of 40 Hz) that was indicated in FIG. 7. In one example, because the display is refreshed after a maximum refresh period followed by a minimum refresh period, as indicated by Refresh N+2 (714) and Refresh N+3 (716), Refresh N+4 (718) is provided after an intermediate refresh safe period to avoid flicker of the displayed image. As indicated in the diagram, the present duration for a new frame may be compared to a threshold calculated as the maximum refresh period minus a margin (802). For example, the frame reinsertion range may include rates corresponding to time periods at and above the calculated threshold. For example, if the calculated present duration is greater than an amount X for more than T time periods, the range of Refresh N+4 (718) may be varied by providing Refresh N+4 (718) to the display earlier as described above. In addition, because Refresh N+4 (718) is now provided earlier, Refresh N+5 (702), containing content from Frame C, may now be provided earlier. Specifically, as indicated in the diagram, Refresh N+5 (702) is provided after a minimum refresh safe period (806), indicated to be approximately 6.94 milliseconds (corresponding to a rate of 144 Hz). Similarly, rather than providing a refresh that follows Refresh N+5 (702) after a maximum refresh period as indicated in FIG. 7, a refresh following Refresh N+5 (702) may be provided after an intermediate refresh safe period (808).

Figure 9:
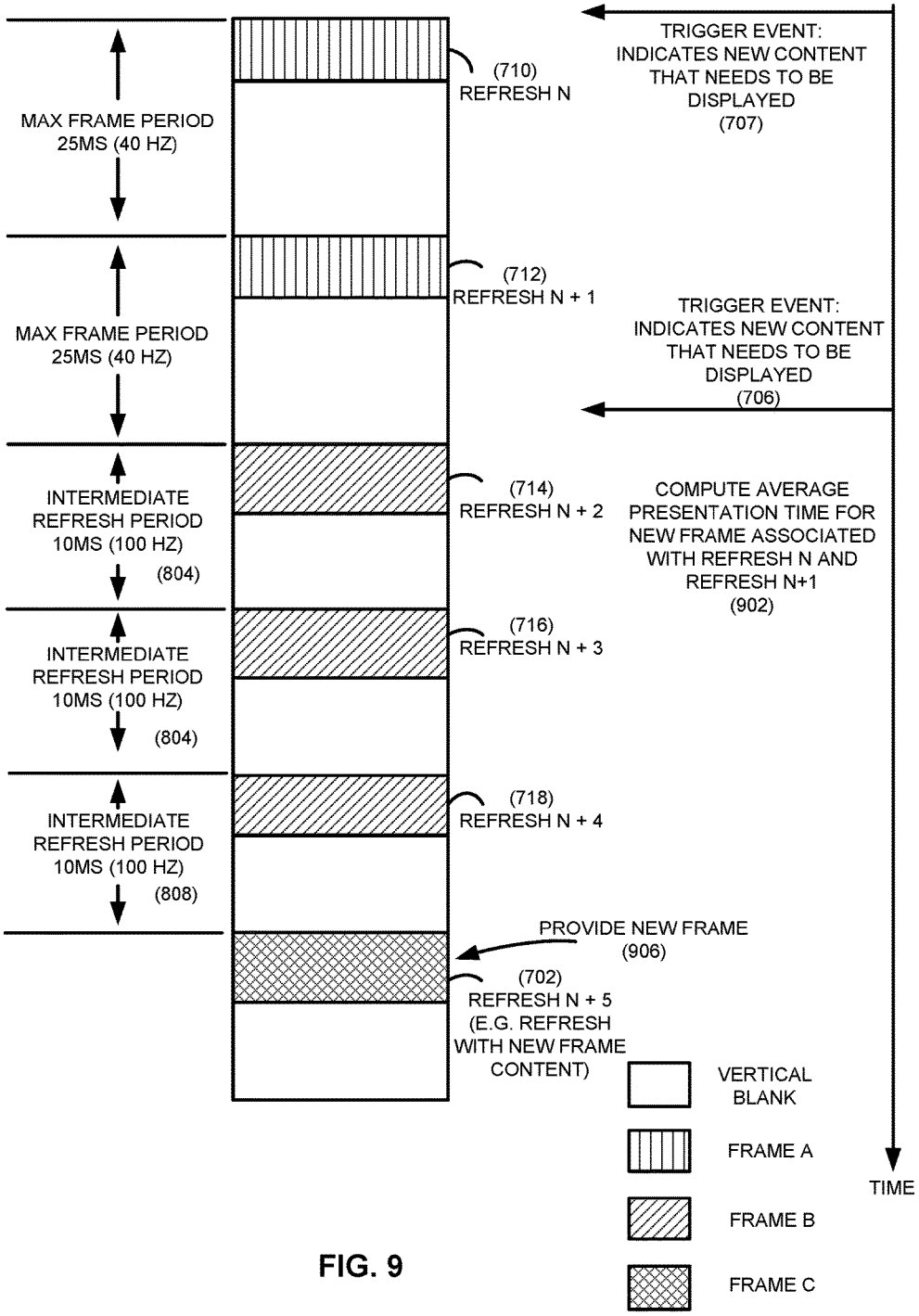
FIG. 9 is an example frame timing diagram illustrating timing advantages of determining an average presentation rate for previously presented frames and providing one or more current frames for display prior to providing a new frame for display.

FIG. 9 is an example frame timing diagram illustrating timing advantages of determining an average presentation rate for previously presented frames and providing one or more current frames for display prior to providing a new frame for display. In this illustration, the presentation time for new frames is tracked to determine an average presentation time. For example, the presentation time of the frame associated with Refresh N (710) and Refresh N+1 (712), which provide content from Frame A, may be computed to be approximately 50 milliseconds (902). By computing presentation times for previous frames, an average presentation time may be computed. As an example, if the average presentation time computed is close to or exceeds the maximum supported refresh period of 25 milliseconds (corresponding to 40 Hz), the display may be refreshed one or more additional times by re-providing the current frame, such as Refresh N+3 (716) and Refresh N+4 (718), at a time corresponding to a rate within an intermediate safe period (804). As a result, Frame C, in the diagram associated with Refresh N+5 (702), is able to be provided to the display (906) when it becomes available and at a time corresponding to a rate within an intermediate safe period (808). Although the intermediate safe period (808) associated with Refresh N+5 (702) is shown to be the same duration as the intermediate safe period (804) associated with Refresh N+3 (716) and Refresh N+4 (718), it will be appreciated that the intermediate safe periods may be of different durations as well. By re-providing one or more additional display refresh cycles with the current frame, a new frame may be provided as it becomes available. In addition, by providing the frames at an intermediate safe period, the display flicker issues may be avoided as well.

The foregoing description has been presented for the purposes of illustration and description. It is not intended to be exhaustive or to limit the invention to the exemplary embodiments disclosed. Many modifications and variations are possible in light of the above teachings. It is intended that the scope of the invention be limited not by this detailed description of examples, but rather by the claims appended hereto. The above detailed description of the embodiments and the examples described therein have been presented for the purposes of illustration and description only and not by limitation. It is therefore contemplated that the present invention cover any and all modifications, variations, or equivalents that fall within the spirit and scope of the basic underlying principles disclosed above and claimed herein.

What is claimed is:

1. A method of providing display content for a variable refresh rate display, the method comprising:

providing first content of a first frame on the display during a refresh safe period ranging between a minimum refresh period and a maximum refresh period;

determining a trigger event indicating that a second frame has been rendered during the refresh safe period;

providing, after the trigger event, second content of the second frame on the display during an intermediate refresh safe period that is greater than the minimum refresh period and less than the maximum refresh period, the intermediate refresh safe period variably set based on a time difference between when the first frame is presented for display and when the second frame is ready to be displayed.

2. The method of claim 1, wherein providing the second content of the second frame during the intermediate refresh safe period comprises determining whether the first content of the first frame has been previously presented for display at least once during the maximum refresh period and at least once during the minimum refresh period.

3. The method of claim 2, wherein providing the second content of the second frame during the intermediate refresh safe period comprises providing display content of a future frame for display based on the determination of whether the first content of the first frame has been previously presented for display.

4. The method of claim 1, wherein providing the second content of the second frame during the intermediate refresh safe period comprises determining an average presentation period for previously presented frames.

5. The method of claim 4, wherein providing the second content of the second frame during the intermediate refresh safe period comprises providing display content of a future frame for display when the average presentation period is between the minimum refresh period and the maximum refresh period.

6. The method of claim 1, wherein providing the second content of the second frame during the intermediate refresh safe period comprises determining an average render rate for previously rendered frames.

7. The method of claim 6, further comprising variably determining the intermediate refresh safe period based on the average render rate for the previously rendered frames.

8. A device capable of providing display content for a variable refresh rate display, the device comprising at least one processor operative to:

provide first content of a first frame on the display during a refresh safe period ranging between a minimum refresh period and a maximum refresh period;

determine a trigger event indicating that a second frame has been rendered during the refresh safe period;

provide, after the trigger event, second content of the second frame on the display during an intermediate refresh safe period that is greater than the minimum refresh period and less than the maximum refresh period, the intermediate refresh safe period variably set based on a time difference between when the first frame is presented for display and when the second frame is ready to be displayed.

9. The device of claim 8, wherein the at least one processor is operative to determine whether the first content of the first frame has been previously presented for display at least once during the maximum refresh period and at least once during the minimum refresh period.

10. The device of claim 9, wherein the at least one processor is operative to provide display content of a future frame for display based on the determination of whether the first content of the first frame has been previously presented for display.

11. The device of claim 8, wherein the at least one processor is operative to determine an average presentation period for previously presented frames.

12. The device of claim 11, wherein the at least one processor is operative to provide display content of a future frame for display when the average presentation period is between the minimum refresh period and the maximum refresh period.

13. The device of claim 8, wherein the at least one processor is operative to determine an average render rate for previously rendered frames.

14. The device of claim 13, wherein the at least one processor is operative to variably determine the intermediate refresh safe period based on the average render rate for the previously rendered frames.

15. A non-transitory computer readable medium comprising executable instructions that when executed by at least one processor cause the at least one processor to:

provide first content of a first frame on the display during a refresh safe period ranging between a minimum refresh period and a maximum refresh period;

determine a trigger event indicating that a second frame has been rendered during the refresh safe period;

provide, after the trigger event, second content of the second frame on the display during an intermediate refresh safe period that is greater than the minimum refresh period and less than the maximum refresh period, the intermediate refresh safe period variably set based on a time difference between when the first frame is presented for display and when the second frame is ready to be displayed.

16. The non-transitory computer readable medium of claim 15, wherein the at least one processor is operative to determine whether the first content of the first frame has been previously presented for display at least once during the maximum refresh period and at least once during the minimum refresh period.

17. The non-transitory computer readable medium of claim 16, wherein the at least one processor is operative to provide display content of a future frame for display based on the determination of whether the first content of the first frame has been previously presented for display.

18. The non-transitory computer readable medium of claim 15, wherein the at least one processor is operative to determine an average presentation period for previously presented frames.

19. The non-transitory computer readable medium of claim 18, wherein the at least one processor is operative to provide display content of a future frame for display when the average presentation period is between the minimum refresh period and the maximum refresh period.

20. The non-transitory computer readable medium of claim 15, wherein the at least one processor is operative to determine an average render rate for previously rendered frames, and operative to variably determine the intermediate refresh safe period based on the average render rate for the previously rendered frames.

* * * * *